US012753956B2

(12) United States Patent
Hamadate et al.

(10) Patent No.: US 12,753,956 B2
(45) Date of Patent: Oct. 6, 2026

(54) HEAT SOURCE UNIT

(71) Applicant: DAIKIN INDUSTRIES, LTD., Osaka (JP)

(72) Inventors: Junichi Hamadate, Osaka (JP); Fumiaki Koike, Osaka (JP); Atsushi Kinoshita, Osaka (JP); Asahi Ono, Osaka (JP); Ayumi Komaki, Osaka (JP); Naritaka Yakura, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 109 days.

(21) Appl. No.: 18/798,903

(22) Filed: Aug. 9, 2024

(65) Prior Publication Data

US 2024/0401854 A1 Dec. 5, 2024

Related U.S. Application Data

(63) Continuation of application No. PCT/JP2023/004856, filed on Feb. 13, 2023.

(30) Foreign Application Priority Data

Feb. 14, 2022 (JP) ..... 2022-020266

(51) Int. Cl.
*F25B 41/26* (2021.01)
*F25B 41/24* (2021.01)

(52) U.S. Cl.
CPC ..... *F25B 41/26* (2021.01); *F25B 41/24* (2021.01); *F25B 2500/17* (2013.01)

(58) Field of Classification Search
CPC ..... F25B 41/30; F25B 41/20; F25B 41/42; F25B 43/006; F25B 49/02; F25B 41/26; F25B 41/24
See application file for complete search history.

(56) References Cited

U.S. PATENT DOCUMENTS 5,131,240 A * 7/1992 Kohashi ..... F25B 41/26 62/324.1
5,685,164 A * 11/1997 Gardner ..... F25B 41/20 251/366
5,743,111 A * 4/1998 Sasaki ..... F25B 13/00 165/110

FOREIGN PATENT DOCUMENTS

JP H09196515 A * 7/1997
JP 2007046880 A * 2/2007
(Continued)

OTHER PUBLICATIONS

International Search Report and Written Opinion mailed on May 9, 2023, received for International Application No. PCT/JP2023/004856, filed on Feb. 13, 2023, 15 pages including English Translation.

(Continued)

*Primary Examiner* — Frantz F Jules
*Assistant Examiner* — Martha Tadesse
(74) *Attorney, Agent, or Firm* — XSENSUS LLP

(57) ABSTRACT

A heat source unit includes: a compressor; refrigerant pipes for a flow of a gas refrigerant having been discharged from the compressor and a flow of a gas refrigerant to be sucked into the compressor; a refrigerant flow path module connected to the refrigerant pipes; and a casing accommodating the compressor, the refrigerant pipes, and the refrigerant flow path module; in which the refrigerant flow path module includes a module body having an upper surface and a lower surface, having a vertical length less than a horizontal length, and provided therein with a flow path for a refrigerant, the refrigerant flow path module is disposed above and apart from a bottom part of the casing, and the refrigerant pipes include a first pipe and a second pipe each communicating with the flow path in the module body and supporting the refrigerant flow path module.

13 Claims, 14 Drawing Sheets

(56) References Cited

FOREIGN PATENT DOCUMENTS

| | | | |
|---|---|---|---|
| JP | 2010-156528 | A | 7/2010 |
| JP | 6925158 | B2 | 8/2021 |

OTHER PUBLICATIONS

English translation of the International Preliminary Report On Patentability (Chapter I) mailed on Aug. 29, 2024, in corresponding PCT/JP2023/004856, 7 pages.

Extended European search report issued on May 8, 2025, in corresponding European patent Application No. 23752978.9, 8 pages.

* cited by examiner

HEAT SOURCE UNIT

CROSS-REFERENCE TO RELATED APPLICATIONS

The present application is a continuation application of International Patent Application No. PCT/JP2023/004856, filed on Feb. 13, 2023, which claims priority to Japanese Patent Application No. 2022-020266, filed on Feb. 14, 2022, the entire disclosure of these applications are incorporated herein by reference.

TECHNICAL FIELD

The present disclosure relates to a heat source unit.

BACKGROUND ART

A refrigeration apparatus including a refrigerant circuit configured to execute vapor compression refrigeration cycle operation has been known to collectively include, in a single unit, a plurality of refrigerant pipes for refrigerant flows, to achieve reduction in size of the refrigerant circuit. For example, PATENT LITERATURE 1 discloses a refrigerant pipe unit provided to a heat source unit of a refrigeration apparatus. This refrigerant pipe unit is constituted by a pair of plate-shaped members stacked to each other and is disposed with plate surfaces of these plate-shaped members directed vertically. The pair of plate-shaped members have stacking surfaces provided with a plurality of grooves for provision of refrigerant passages, and the upper plate-shaped member has an upper surface provided with communication holes communicating with the refrigerant passages. The upper surface of the upper plate-shaped member is provided with functional blocks such as a compressor and a switching valve, and the functional blocks are connected to the refrigerant pipe unit via the communication holes.

CITATION LIST

Patent Literature

PATENT LITERATURE 1: Japanese Laid-Open Patent Publication No. 2010-156528

SUMMARY

A heat source unit according to the present disclosure includes: a compressor; refrigerant pipes for a flow of a gas refrigerant having been discharged from the compressor and a flow of a gas refrigerant to be sucked into the compressor; a refrigerant flow path module connected to the refrigerant pipes; and a casing accommodating the compressor, the refrigerant pipes, and the refrigerant flow path module, in which the refrigerant flow path module includes a module body having an upper surface and a lower surface, having a vertical length less than a horizontal length, and provided therein with a flow path for a refrigerant, the refrigerant flow path module is disposed above and apart from a bottom part of the casing, and the refrigerant pipes include a first pipe and a second pipe each communicating with the flow path in the module body and supporting the refrigerant flow path module.

DETAILED DESCRIPTION

Embodiments of the present disclosure will be described in detail hereinafter with reference to the accompanying drawings.

First Embodiment

Figure 1:
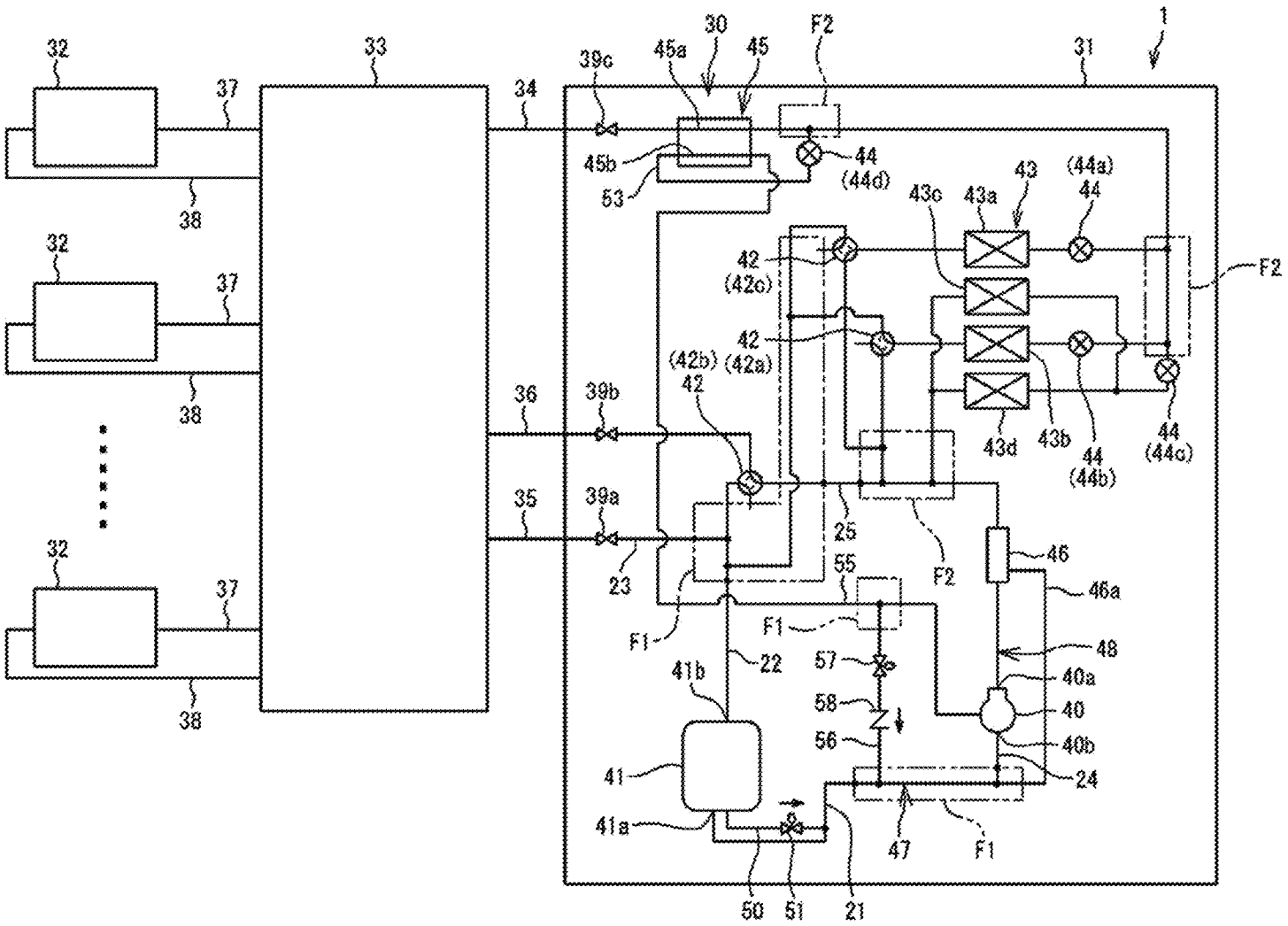
FIG. 1 is a pattern view depicting a refrigerant circuit of a refrigeration apparatus according to a first embodiment of the present disclosure.

FIG. 1 is a pattern view depicting a refrigerant circuit of a refrigeration apparatus according to the first embodiment of the present disclosure.

A refrigeration apparatus 1 includes a refrigerant circuit configured to execute vapor compression refrigeration cycle operation. The refrigeration apparatus 1 according to the present embodiment is configured as an air conditioner. As depicted in FIG. 1, the air conditioner 1 includes an outdoor unit (heat source unit) 31, a plurality of indoor units (utilization units) 32, and a flow path switching device 33. The outdoor unit 31 and the flow path switching device 33, as well as the flow path switching device 33 and the indoor units 32 are respectively connected via connection pipes 34, 35, 36, 37, and 38. The air conditioner 1 according to the present embodiment is of a so-called freely cooling and heating type configured to allow each of the indoor units 32 to individually execute cooling operation or heating operation. The refrigeration apparatus 1 is not limited to the air conditioner but may alternatively be configured as a refrigerator, a freezer, a hot-water supplier, or the like.

(Configuration of Refrigerant Circuit)

The outdoor unit 31 includes a refrigerant circuit 30. The refrigerant circuit 30 is connected to a refrigerant circuit in the flow path switching device 33 via a liquid connection pipe 34, a sucked gas connection pipe 35, and a high and low-pressure gas connection pipe 36. The refrigerant circuit in the flow path switching device 33 is connected to a refrigerant circuit in each of the indoor units 32 via the connection pipes 37 and 38.

The refrigerant circuit 30 includes a first shutoff valve 39*a*, a second shutoff valve 39*b*, a third shutoff valve 39*c*, a compressor 40, an accumulator 41, a plurality of flow path switching valves (switching mechanisms) 42 (42*a*, 42*b*, and 42*c*), an outdoor heat exchanger 43, a plurality of expansion valves 44 (44*a*, 44*b*, 44*c*, and 44*d*), a subcooler 45, an oil separator 46, and the like. These components are connected via refrigerant pipes to constitute the refrigerant circuit. The outdoor unit 31 is provided therein with a fan 62 (see FIG. 2), a controller 61*a* (see FIG. 3), and the like.

The first shutoff valve 39*a* has a first end connected to the sucked gas connection pipe 35. The first shutoff valve 39*a* has a second end connected to a refrigerant pipe extending to the accumulator 41.

The second shutoff valve 39*b* has a first end connected to the high and low-pressure gas connection pipe 36. The second shutoff valve 39*b* has a second end connected to a refrigerant pipe extending to the flow path switching valve 42*b*.

The third shutoff valve 39*c* has a first end connected to the liquid connection pipe 34. The third shutoff valve 39*c* has a second end connected to a refrigerant pipe extending to the subcooler 45.

The compressor 40 has a hermetic structure incorporating a compressor motor, and is of a positive-displacement type such as a scroll type or a rotary type. The compressor 40 compresses a low-pressure refrigerant sucked from a suction pipe 47 and then discharges the compressed refrigerant from a discharge pipe 48. The compressor 40 contains refrigerating machine oil. This refrigerating machine oil occasionally circulates in the refrigerant circuit 30 along with a refrigerant. The compressor 40 is a kind of container.

The oil separator 46 is a container used for separation of the refrigerating machine oil from the refrigerant discharged from the compressor 40. The refrigerating machine oil thus separated is returned to the compressor 40 via an oil return tube 46*a*.

The accumulator 41 is a container temporarily storing the low-pressure refrigerant to be sucked into the compressor 40 and used for separation between a gas refrigerant and a liquid refrigerant. The accumulator 41 has an inflow port 41*b* connected to a refrigerant pipe extending from the first shutoff valve 39*a*. The accumulator 41 has an outflow port 41*a* connected to the suction pipe 47. The accumulator 41 is connected with a first end of an oil return tube 50. The oil return tube 50 has a second end connected to the suction pipe 47. The oil return tube 50 is provided to return the refrigerating machine oil from the accumulator 41 to the compressor 40. The oil return tube 50 is provided with a first on-off valve 51. The first on-off valve 51 is constituted by an electromagnetic valve. When the first on-off valve 51 is opened, the refrigerating machine oil in the accumulator 41 passes through the oil return tube 50 and is sucked into the compressor 40 along with the refrigerant flowing in the suction pipe 47.

The flow path switching valves 42 are each configured as a four-way switching valve. Each of the flow path switching valves 42 switches a refrigerant flow in accordance with an operation condition of the air conditioner 1. Each of the flow path switching valves 42 has a refrigerant inflow port connected with a refrigerant pipe extending from the oil separator 46.

Each of the flow path switching valves 42 is configured to shut off a refrigerant flow in a single refrigerant flow path during operation, and actually functions as a three-way valve. The plurality of flow path switching valves 42 will hereinafter also be referred to as a first flow path switching valve 42*a*, a second flow path switching valve 42*b*, and a third flow path switching valve 42*c*.

Examples of the expansion valves 44 include a motor valve having an adjustable opening degree. Each of the expansion valves 44 has the opening degree adjusted in accordance with the operation condition, and decompresses the refrigerant passing therethrough in accordance with the opening degree. The plurality of expansion valves 44 will hereinafter also be referred to as a first expansion valve 44*a*, a second expansion valve 44*b*, a third expansion valve 44*c*, and a fourth expansion valve 44*d*.

The outdoor heat exchanger 43 is of a cross-fin type or a microchannel type. The outdoor heat exchanger 43 includes a first heat exchange unit 43*a*, a second heat exchange unit 43*b*, a third heat exchange unit 43*c*, and a fourth heat exchange unit 43*d*. The first heat exchange unit 43*a* has a gas side end connected to a refrigerant pipe extending to the third flow path switching valve 42*c*. The first heat exchange unit 43*a* has a liquid side end connected to a refrigerant pipe extending to the first expansion valve 44*a*.

The second heat exchange unit 43*b* has a gas side end connected to a refrigerant pipe extending to the first flow path switching valve 42*a*. The second heat exchange unit 43*b* has a liquid side end connected to a refrigerant pipe extending to the second expansion valve 44*b*.

The third heat exchange unit 43*c* and the fourth heat exchange unit 43*d* each have a gas side end connected to a refrigerant pipe extending from the oil separator 46 and branched. The third heat exchange unit 43*c* and the fourth heat exchange unit 43*d* each have a liquid side end connected to a refrigerant pipe extending to the third expansion valve 44*c*.

The subcooler 45 includes a first heat transfer tube 45*a* and a second heat transfer tube 45*b*. The first heat transfer tube 45*a* has a first end connected to a refrigerant pipe extending to the first to third expansion valves 44*a*, 44*b*, and 44*c*. The first heat transfer tube 45*a* has a second end connected to a refrigerant pipe extending to the third shutoff valve 39*c*. The second heat transfer tube 45*b* has a first end connected to a first branching tube 53 branching from a refrigerant pipe provided between the first heat transfer tube 45*a* and the first to third expansion valves 44*a*, 44*b*, and 44*c*. The first branching tube 53 is provided with the fourth expansion valve 44*d*. The second heat transfer tube 45*b* has a second end connected to a first end of an injection pipe 55. The injection pipe 55 has a second end connected to an intermediate port of the compressor 40.

The injection pipe 55 is connected with a first end of a second branching tube 56. The second branching tube 56 has a second end (outlet end) connected to the suction pipe 47. The second branching tube 56 is provided with a second on-off valve 57 and a check valve 58. The second on-off valve 57 is constituted by an electromagnetic valve.

The subcooler 45 causes heat exchange between the refrigerant flowing from the compressor 40, passing through the outdoor heat exchanger 43 and the expansion valves 44, and flowing in the first heat transfer tube 45*a*, and the refrigerant decompressed by the expansion valve 44*d* and flowing in the second heat transfer tube 45*b*, to subcool the refrigerant flowing in the first heat transfer tube 45*a*. The refrigerant flowing in the second heat transfer tube 45*b* passes through the injection pipe 55 and is sucked into the intermediate port of the compressor 40. When the second on-off valve 57 is opened, the refrigerant flowing in the injection pipe 55 branches into the second branching tube 56 to flow therein and passes through the suction pipe 47 to be sucked into the compressor 40.

(Structure of Outdoor Unit)

Figure 2:
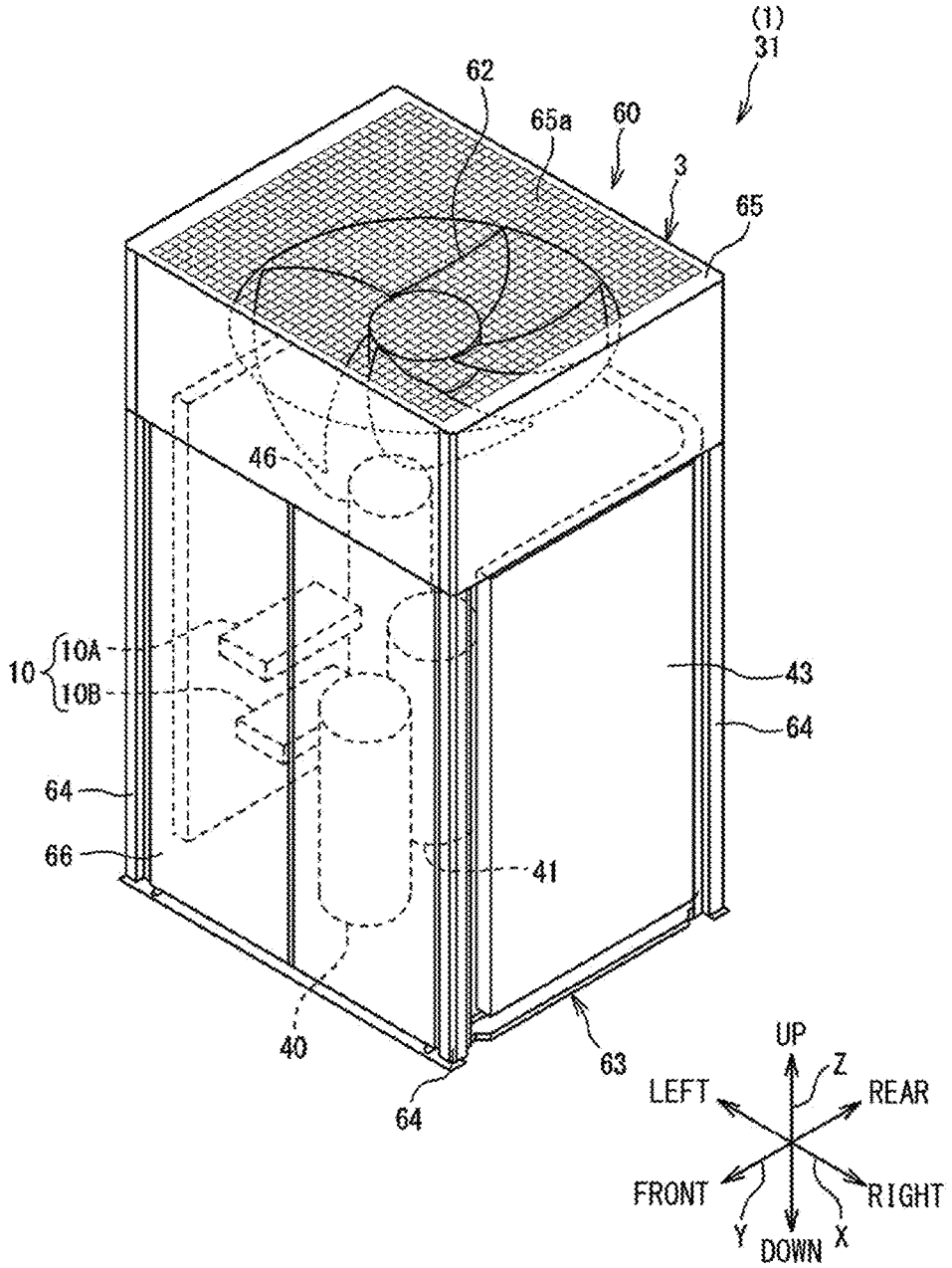
FIG. 2 is a perspective view of the refrigeration apparatus.
Figure 3:
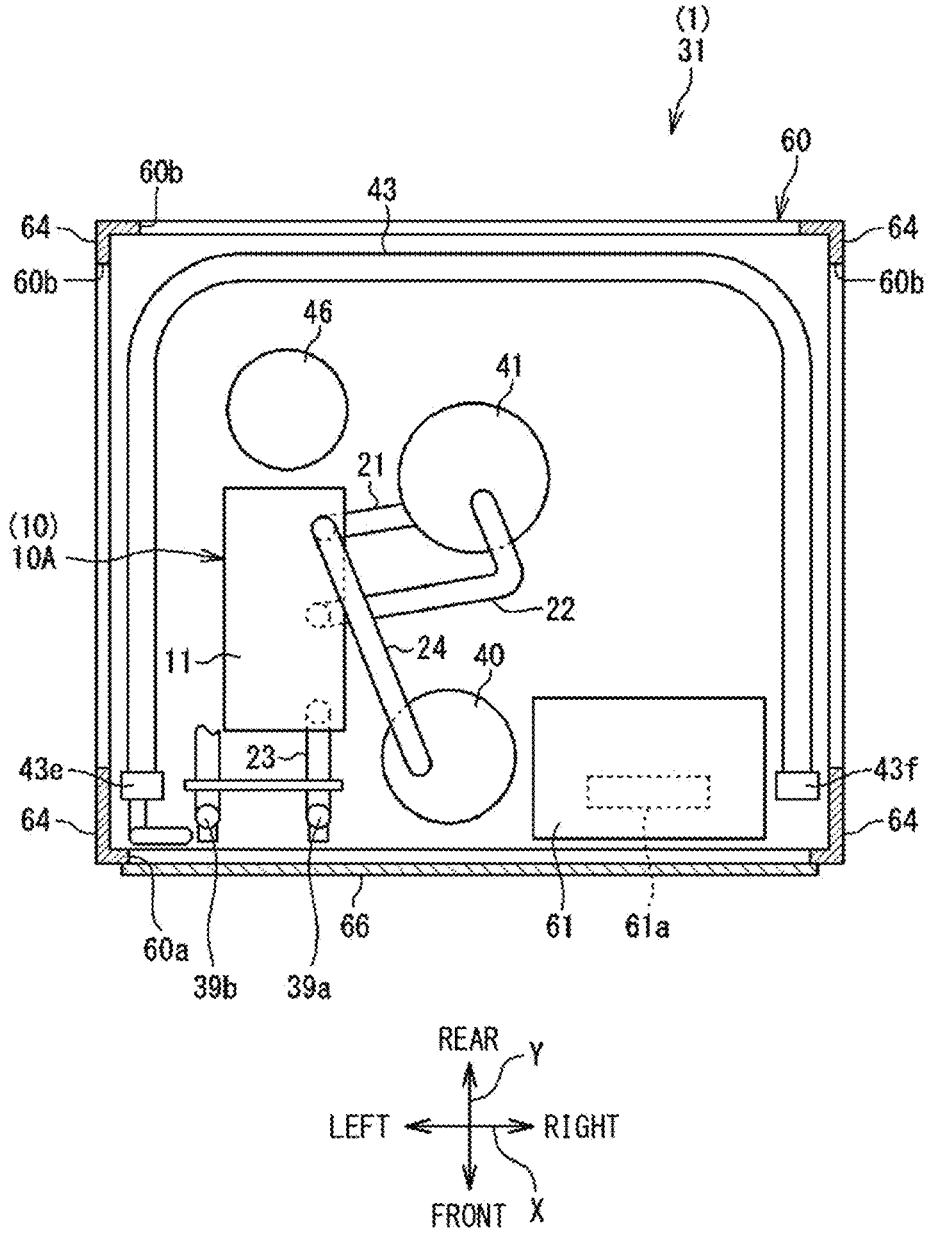
FIG. 3 is a plan view depicting the interior of the refrigeration apparatus.

Description is made below to the outdoor unit (heat source unit) 31 in terms of its specific structure. FIG. 2 is a perspective view of the refrigeration apparatus. FIG. 3 is a plan view depicting the interior of the refrigeration apparatus.

The following description refers to a transverse direction, an anteroposterior direction, and a vertical direction according to arrows X, Y, and Z indicated in FIG. 2 and FIG. 3. Specifically in the following description, the arrow X in FIG. 2 and FIG. 3 indicates a first direction corresponding to the transverse direction, the arrow Y indicates a second direction corresponding to the anteroposterior direction, and the arrow Z indicates a third direction corresponding to the vertical direction. Note that these directions are described exemplarily without limiting the present disclosure. Alternatively, the first direction X may correspond to the anteroposterior direction and the second direction Y may correspond to the transverse direction.

As depicted in FIG. 2 and FIG. 3, the outdoor unit 31 includes a casing 60 accommodating components such as the compressor 40, the accumulator 41, the outdoor heat exchanger 43, and the oil separator 46 constituting the refrigerant circuit, an electric component unit 61, the fan 62, and the like. The fan 62 is provided at the top of the casing 60.

The casing 60 has a substantially rectangular parallelepiped shape. The casing 60 has a bottom plate 63, a support 64, a top panel 65, a front panel 66, and the like. The bottom plate 63 has a quadrilateral shape in a top view. The support 64 is constituted by a long member having a substantially L sectional shape and elongating in the vertical direction, and is attached to each of four corners of the bottom plate 63.

The top panel 65 has a quadrilateral shape substantially identically to the bottom plate 63, and is disposed above and apart from the bottom plate 63. The top panel 65 has four corners attached to upper ends of the supports 64. The top panel 65 is provided with a vent hole having a substantially quadrilateral shape and provided with a grill 65*a* preventing entry of foreign matters.

As depicted in FIG. 3, the casing 60 has a front surface provided with an opening 60*a* for maintenance. The opening 60*a* is closed by the front panel (front side plate) 66. Detaching the front panel 66 from the casing 60 enables maintenance, replacement, and the like of the components in the casing 60 via the opening 60*a*.

The bottom plate 63 of the casing 60 is provided thereon with components such as the compressor 40, the accumulator 41, the outdoor heat exchanger 43, and the oil separator 46.

The outdoor heat exchanger 43 is disposed to correspond to (face) three side surfaces of the casing 60. Specifically, the outdoor heat exchanger 43 has a U shape in a top view to extend along a left side surface, a right side surface, and a rear side surface of the casing 60. The outdoor heat exchanger 43 has a first end part provided with a gas header 43*e*, and a second end part provided with a liquid header 43*f*. The left side surface, the right side surface, and the rear side surface of the casing 60 are each provided with an intake port 60*b* for entry of outdoor air.

The outdoor unit 31 is configured to, when the fan 62 is driven, receive air via the intake port 60*b* of the casing 60, cause heat exchange between the received air and the outdoor heat exchanger 43, and then send out air upward from the top of the casing 60.

The compressor 40 is disposed at a substantially center in the transverse direction X in the vicinity of the front surface of the casing 60. The electric component unit 61 is disposed in the vicinity of the front surface of the casing 60 and adjacent to a right side of the compressor 40. The compressor 40 is provided therebehind with the accumulator 41. The accumulator 41 has a left side provided with the oil separator 46. The electric component unit 61 includes the controller 61*a* configured to control behavior of the compressor 40, the valves 42 and 44, the fan 62, and the like.

(Configuration of Refrigerant Flow Path Module)

Figure 4:
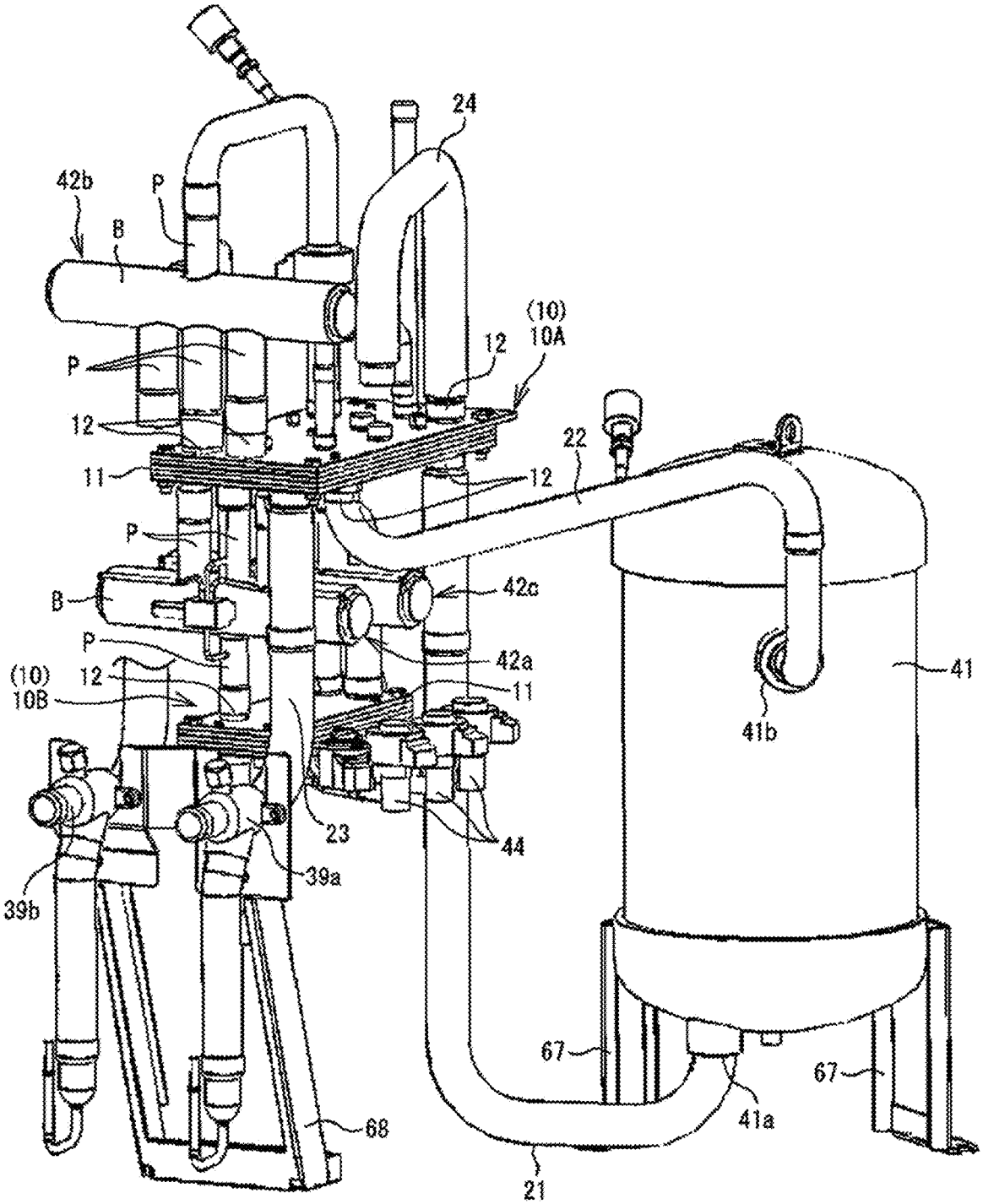
FIG. 4 is a perspective view of a refrigerant flow path module.
Figure 5:
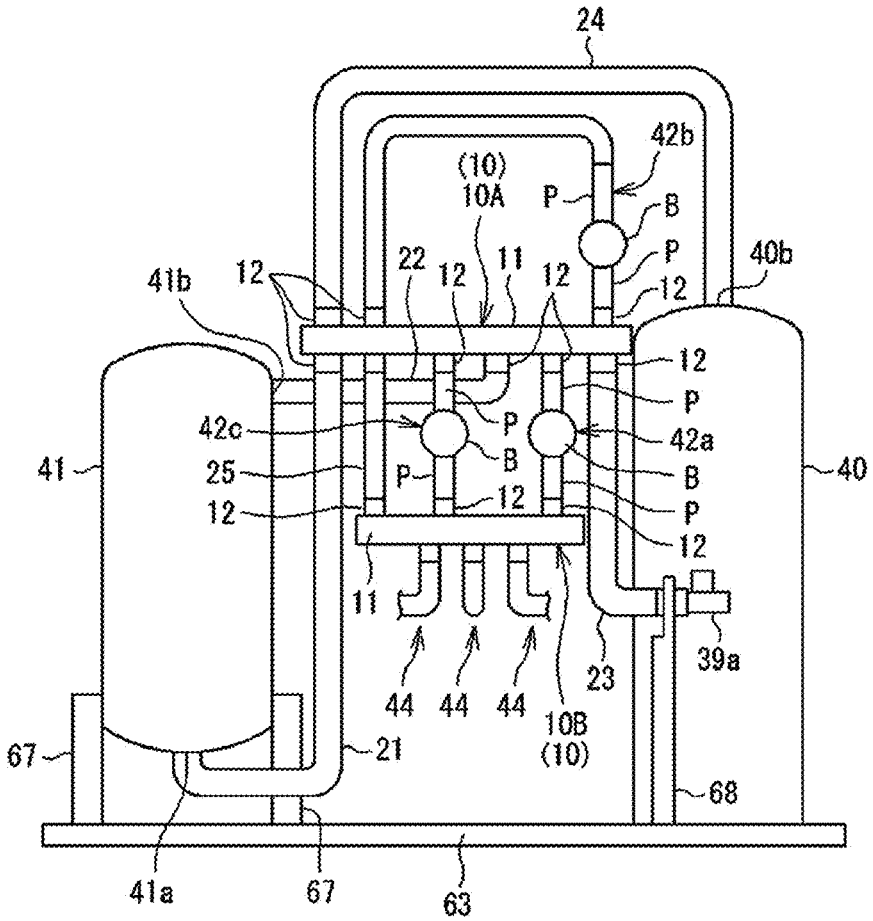
FIG. 5 is a schematic side view of the refrigerant flow path module.

FIG. 4 is a perspective view of a refrigerant flow path module. FIG. 5 is a schematic side view of the refrigerant flow path module.

As depicted in FIG. 2 to FIG. 5, the outdoor unit is provided with a refrigerant flow path module 10. The refrigerant flow path module 10 is a module (unit) constituting part of flow paths of refrigerant pipes connecting components such as the compressor 40, the accumulator 41, the flow path switching valves 42, the outdoor heat exchanger 43, the expansion valves 44, and the oil separator 46. Specifically, the refrigerant flow path module 10 according to the present embodiment constitutes refrigerant flow paths disposed in frames F1 and frames F2 each indicated by a two-dot chain line in FIG. 1.

The refrigerant flow path module 10 according to the present embodiment includes an upper refrigerant flow path module 10A and a lower refrigerant flow path module 10B. The upper refrigerant flow path module 10A constitutes the refrigerant flow paths in the frames F1 in FIG. 1. The lower refrigerant flow path module 10B constitutes the refrigerant flow paths in the frames F2 in FIG. 1.

The upper refrigerant flow path module 10A and the lower refrigerant flow path module 10B each include a module body 11 having an internal flow path, and a joint tube (refrigerant tube) 12 attached to the module body 11 and communicating with the flow path in the module body 11. In the present specification, the module body 11 of the upper refrigerant flow path module 10A may be called a first module body 11 and the module body 11 of the lower refrigerant flow path module 10B may be called a second module body.

The module body 11 is constituted by a plurality of stacked plates, and has a plate or block shape. The module body 11 has an upper surface and a lower surface each having a rectangular shape in a planar view. The module body 11 is disposed such that the upper surface and the lower surface are directed in a horizontal direction. The module body 11 has a thickness (vertical length) less than lengths of a long side and a short side of the rectangular shape. The module body 11 thus has a flat shape and is disposed in parallel with the horizontal direction. The module body 11 may not be disposed exactly in parallel with the horizontal direction, and may exemplarily be slanted by at most ±100 from the horizontal direction.

The upper refrigerant flow path module 10A and the lower refrigerant flow path module 10B are disposed in parallel with each other. The upper refrigerant flow path module 10A and the lower refrigerant flow path module 10B are disposed to be overlapped with each other in a top view. The upper refrigerant flow path module 10A is larger in area than the lower refrigerant flow path module 10B in a top view. The lower refrigerant flow path module 10B is disposed in a vertical projection area of the upper refrigerant flow path module 10A.

The joint tube 12 is a cylinder attached to each of the upper and lower surfaces of the module body 11. The joint tubes 12 are disposed to have axes vertical to the upper and lower surfaces of the module body 11. The joint tube 12 is connected with a refrigerant pipe constituting a refrigerant circuit.

As depicted in FIG. 3, the refrigerant flow path module 10 is disposed on the left side (a first side in the first direction X) of the compressor 40 and the accumulator 41. The refrigerant flow path module 10 is disposed ahead (on a first side in the second direction Y) of the oil separator 46. The refrigerant flow path module 10 according to the present embodiment, specifically the upper refrigerant flow path module 10A, is supported by a refrigerant pipe via components constituting the refrigerant circuit fixed onto the bottom plate 63 of the casing 60. The lower refrigerant flow path module 10B is substantially supported by the upper refrigerant flow path module 10A via a refrigerant pipe and the components constituting the refrigerant circuit.

The upper refrigerant flow path module 10A will be specifically described in terms of its support structure. The upper refrigerant flow path module 10A has a lower end connected with a refrigerant pipe 21 connected to the refrigerant outflow port 41*a* of the accumulator 41 and a refrigerant pipe 22 connected to the refrigerant inflow port 41*b*. As depicted in FIG. 1, the refrigerant pipe 21 constitutes part of a flow path (second flow path) for a refrigerant flow between a suction side of the compressor 40 and the flow path switching valves 42*a* to 42*c*. The refrigerant pipe 22 also constitutes part of the flow path (second flow path) for the refrigerant flow between the suction side of the compressor 40 and the flow path switching valves 42*a* to 42*c*.

As depicted in FIG. 5, the accumulator 41 is attached and fixed to a fixture 67 provided on the bottom plate 63 of the casing 60 of the outdoor unit 31. The refrigerant outflow port 41*a* is provided at the bottom of the accumulator 41. The refrigerant pipe 21 is bent and extends upward from a connecting portion to the refrigerant outflow port 41*a*, and has an upper end connected to the joint tube 12 provided on the lower surface of the module body 11 of the upper refrigerant flow path module 10A. The refrigerant inflow port 41*b* is provided at the top of the accumulator 41. The refrigerant pipe 22 is bent vertically and extends toward the upper refrigerant flow path module 10A from a connecting portion to the refrigerant inflow port 41*b*, and is connected to the joint tube 12 provided on the lower surface of the module body (first module body) 11 of the upper refrigerant flow path module 10A.

The lower end of the upper refrigerant flow path module 10A is also connected with a refrigerant pipe 23 connected to the first shutoff valve (gas shutoff valve) 39*a* serving as an inlet for a gas refrigerant from the flow path switching device 33 (see FIG. 1). As depicted in FIG. 1, the refrigerant pipe 23 constitutes part of a flow path (third flow path) for a refrigerant flow between the first shutoff valve 39*a* and the flow path switching valve 42*b*. As depicted in FIG. 5, the first shutoff valve 39*a* is attached and fixed to a fixture 68 provided on the bottom plate 63. The refrigerant pipe 23 is bent and extends upward from the first shutoff valve 39*a*, and has an upper end connected to the joint tube 12 provided on the lower surface of the module body 11 of the upper refrigerant flow path module 10A.

The upper refrigerant flow path module 10A is supported by the refrigerant pipe 21, the refrigerant pipe 22, and the refrigerant pipe 23. Specifically, the upper refrigerant flow path module 10A is supported from below by the refrigerant pipe 21, the refrigerant pipe 22, and the refrigerant pipe 23. The upper refrigerant flow path module 10A is disposed above and apart from the bottom plate 63 of the casing 60. The refrigerant pipe 21, the refrigerant pipe 22, and the refrigerant pipe 23 are gas pipes for a gas refrigerant flow. The gas pipes are larger in pipe diameter and higher in strength than a liquid pipe for a liquid refrigerant flow. The upper refrigerant flow path module 10A is thus stably supported by these refrigerant pipes 21, 22, and 23. The refrigerant pipe 21 and the refrigerant pipe 22 are connected to the accumulator 41 fixed to the casing 60, whereas the refrigerant pipe 23 is connected to the first shutoff valve 39*a* fixed to the casing 60. Accordingly, the upper refrigerant flow path module 10A is more stably supported by the refrigerant pipes 21, 22, and 23 via the components 41 and 39*a* constituting the refrigerant circuit fixed to the casing 60.

Figure 6:
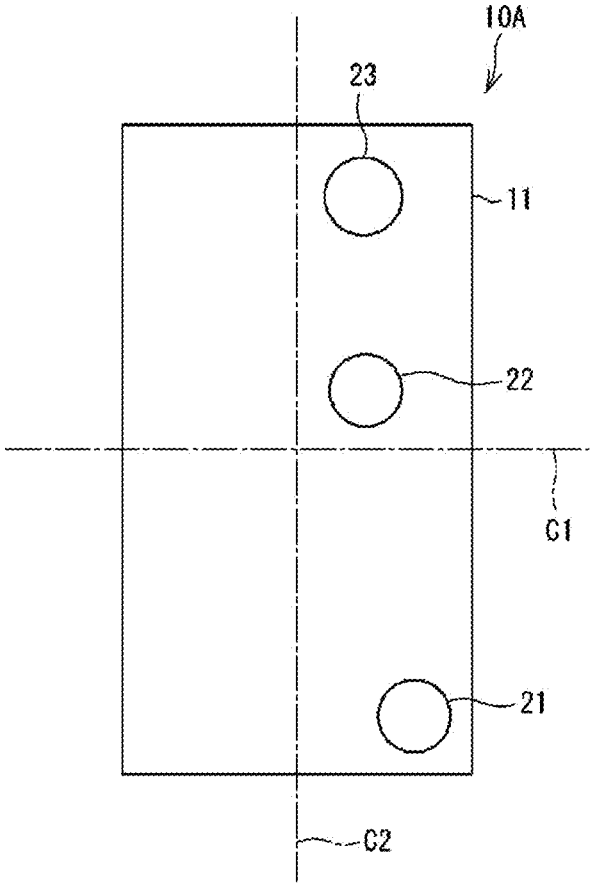
FIG. 6 is a bottom view of a schematic module body, indicating disposition of refrigerant pipes supporting the refrigerant flow path module.

FIG. 6 is a bottom view of a schematic module body, indicating disposition of refrigerant pipes supporting the refrigerant flow path module.

The three refrigerant pipes 21, 22, and 23 supporting the upper refrigerant flow path module 10A are connected at positions distributed on both sides of a center C1 in a longitudinal direction of the module body 11. Specifically, the refrigerant pipe 22 and the refrigerant pipe 23 are disposed on a first side of the center C1 in the longitudinal direction, whereas the refrigerant pipe 21 is disposed on a second side of the center C1 in the longitudinal direction. The plurality of refrigerant pipes 21, 22, and 23 is accordingly distributed on both sides of the center C1 in the longitudinal direction of the module body 11. The plurality of refrigerant pipes 21, 22, and 23 is dispersed in the longitudinal direction of the module body 11. The plurality of refrigerant pipes 21, 22, and 23 can thus stably support the upper refrigerant flow path module 10A. The plurality of refrigerant pipes 21, 22, and 23 according to the present embodiment is clustered on a first side in a short direction of the module body 11.

Figure 7:
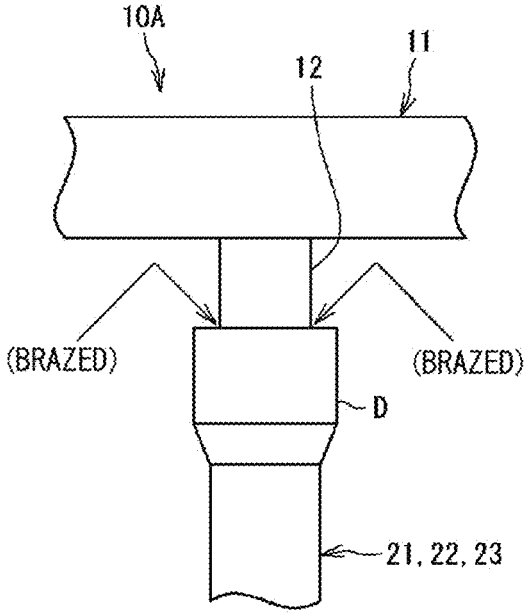
FIG. 7 is an enlarged front view of a connecting portion between the refrigerant flow path module and a refrigerant pipe.

FIG. 7 is an enlarged front view of a connecting portion between the refrigerant flow path module and a refrigerant pipe.

The joint tube 12 provided on the lower surface of the module body 11 of the upper refrigerant flow path module 10A has an upper end connected to the module body 11 and a lower end connected to the refrigerant pipe 21, 22, or 23. The refrigerant pipe 21, 22, or 23 connected to the joint tube 12 has an upper end part provided with a diameter expanded part D processed to be flared to have an increased diameter. The upper end part of the refrigerant pipe 21, 22, or 23 receives a lower end part of the joint tube 12 to be brazed together. Accordingly, connection between the joint tube 12 and the refrigerant pipe 21, 22, or 23 enables brazing from above to an upper end surface of the refrigerant pipe 21, 22, or 23 and facilitates manual brazing.

As depicted in FIG. 5, the upper surface of the module body 11 of the upper refrigerant flow path module 10A is connected with a refrigerant pipe 24 connected to a refrigerant inflow port 40*b* of the compressor 40. As depicted in FIG. 1, the refrigerant pipe 24 constitutes part of the flow path (second flow path) for a refrigerant flow between the suction side of the compressor 40 and the flow path switching valves 42*a* to 42*c*. The refrigerant pipe 24 extends upward from a connecting portion to the refrigerant inflow port 40*b* of the compressor 40, is further bent to extend horizontally, is bent again to extend downward, and has a lower end connected to the joint tube 12 provided on the upper surface of the module body 11.

Accordingly, the upper refrigerant flow path module 10A is supported also from above by the refrigerant pipe 24. The refrigerant pipe 24 is a gas pipe for a gas refrigerant flow, and is larger in diameter and higher in strength than a liquid pipe. The upper refrigerant flow path module 10A is thus stably supported by the refrigerant pipe 24. The compressor 40 is fixed via a fixture or the like provided on the bottom plate 63 of the casing. Accordingly, the upper refrigerant flow path module 10A is more stably supported by the refrigerant pipe 24 via the compressor 40 fixed to the bottom plate 63.

The upper refrigerant flow path module 10A has an upper end connected with the flow path switching valve 42*b*. This flow path switching valve 42*b* includes a valve body B incorporating a valve disc, and a plurality of ports P each serving as a refrigerant outlet or inlet for the valve body B. The ports P project upward and downward from the valve body B. Among these ports, the port P projecting downward is connected directly to the joint tube 12 provided at the top of the upper refrigerant flow path module 10A.

The lower refrigerant flow path module 10B is disposed below and apart from the upper refrigerant flow path module 10A. The lower refrigerant flow path module 10B is disposed above and apart from the bottom plate 63 of the casing 60. The upper refrigerant flow path module 10A and the lower refrigerant flow path module 10B interpose the flow path switching valves 42*a* and 42*c*. These flow path switching valves 42*a* and 42*c* each include a valve body B incorporating a valve disc, and a plurality of ports P each serving as a refrigerant outlet or inlet for the valve body B. The ports P project upward and downward from the valve body B. The port P projecting upward is connected directly to the joint tube 12 provided on the lower surface of the module body 11 of the upper refrigerant flow path module 10A. The port P projecting downward is connected directly to the joint tube 12 provided on the upper surface of the module body (second module body) 11 of the lower refrigerant flow path module 10B.

The upper refrigerant flow path module 10A and the lower refrigerant flow path module 10B interpose a refrigerant pipe 25. As depicted in FIG. 1, the refrigerant pipe 25 constitutes part of a flow path (first flow path) for a refrigerant flow between a discharge side of the compressor 40 and the flow path switching valve 42*b*. More specifically, the refrigerant pipe 25 constitutes part of a flow path for a refrigerant flow between the flow path switching valve 42*b* and the oil separator 46. As depicted in FIG. 5, this refrigerant pipe 25 extends linearly in the vertical direction, and has an upper end connected to the joint tube 12 provided on the lower surface of the module body 11 of the upper refrigerant flow path module 10A, and a lower end connected to the joint tube 12 provided on the upper surface of the module body 11 of the lower refrigerant flow path module 10B. The refrigerant pipe 25 thus connects the upper refrigerant flow path module 10A and the lower refrigerant flow path module 10B in a shortest distance.

As depicted in FIG. 4, the lower refrigerant flow path module 10B is has a lower end connected with the plurality of expansion valves 44. The lower refrigerant flow path module 10B is connected with the upper refrigerant flow path module 10A by the flow path switching valves 42*a* and 42*c* and the refrigerant pipe 25, and is supported from above by the upper refrigerant flow path module 10A via these components.

Modification Examples

Figure 8:
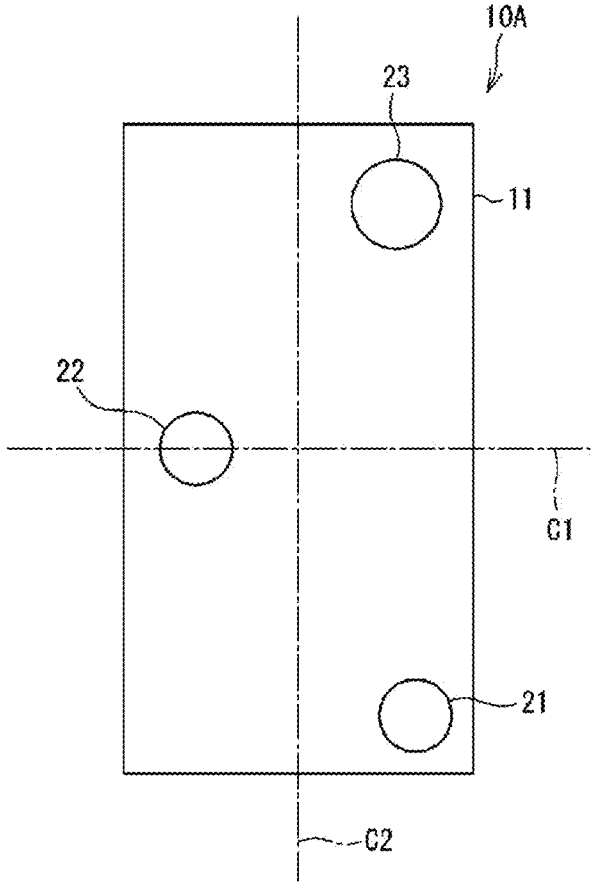
FIG. 8 is a bottom view of a schematic module body, indicating disposition of refrigerant pipes supporting a refrigerant flow path module according to a modification example.

FIG. 8 is a bottom view of a schematic module body, indicating disposition of pipes supporting a refrigerant flow path module according to a modification example.

The three refrigerant pipes 21, 22, and 23 supporting the upper refrigerant flow path module 10A may alternatively be disposed in the manner depicted in FIG. 8 instead of the manner depicted in FIG. 6. Among the three refrigerant pipes 21, 22, and 23, the two refrigerant pipes 21 and 23 are connected at positions distributed on both sides of the center C1 in the longitudinal direction of the module body 11. On the other hand, the remaining single refrigerant pipe 22 is disposed on the center C1 in the longitudinal direction of the module body 11. The two refrigerant pipes 21 and 23 and the single refrigerant pipe 22 are distributed on both sides of a center C2 in the short direction of the module body 11.

According to this modification example, the plurality of refrigerant pipes 21, 22, and 23 is distributed on both sides of the center C2 in the short direction of the module body 11 as well as on both sides of the center C1 in the longitudinal direction. Furthermore, the plurality of refrigerant pipes 21, 22, and 23 is dispersed in the longitudinal direction of the module body 11. The plurality of refrigerant pipes 21, 22, and 23 can thus more stably support the upper refrigerant flow path module 10A.

Figure 9:
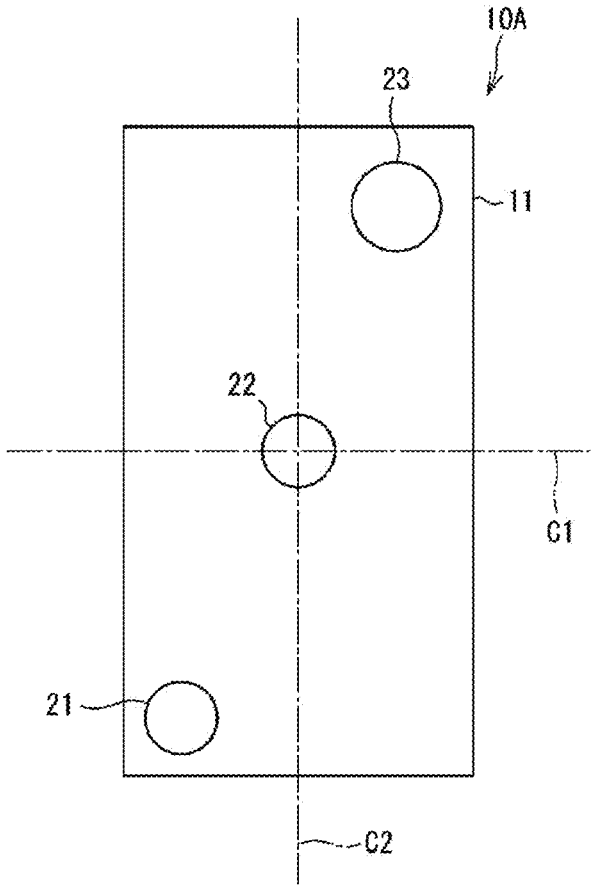
FIG. 9 is a bottom view of a schematic module body, indicating disposition of refrigerant pipes supporting a refrigerant flow path module according to another modification example.

FIG. 9 is a bottom view of a schematic module body, indicating disposition of pipes supporting a refrigerant flow path module according to another modification example.

The three refrigerant pipes supporting the upper refrigerant flow path module 10A may alternatively be disposed in the manner depicted in FIG. 9 instead of the manner depicted in FIG. 6. Among the three refrigerant pipes 21, 22, and 23, the two refrigerant pipes 21 and 23 are connected at positions distributed on both sides of the center C1 in the longitudinal direction of the module body 11 and on both sides of the center C2 in the short direction. The remaining single refrigerant pipe 22 is disposed on the center C1 in the longitudinal direction of the module body 11 and the center C2 in the short direction.

According to this modification example, the plurality of refrigerant pipes 21, 22, and 23 is distributed on both sides of the center C2 in the short direction of the module body 11 as well as on both sides of the center C1 in the longitudinal direction. Furthermore, the plurality of refrigerant pipes 21, 22, and 23 is dispersed in the longitudinal direction and the short direction of the module body 11. The plurality of refrigerant pipes 21, 22, and 23 can thus more stably support the upper refrigerant flow path module 10A.

Second Embodiment

Figure 10:
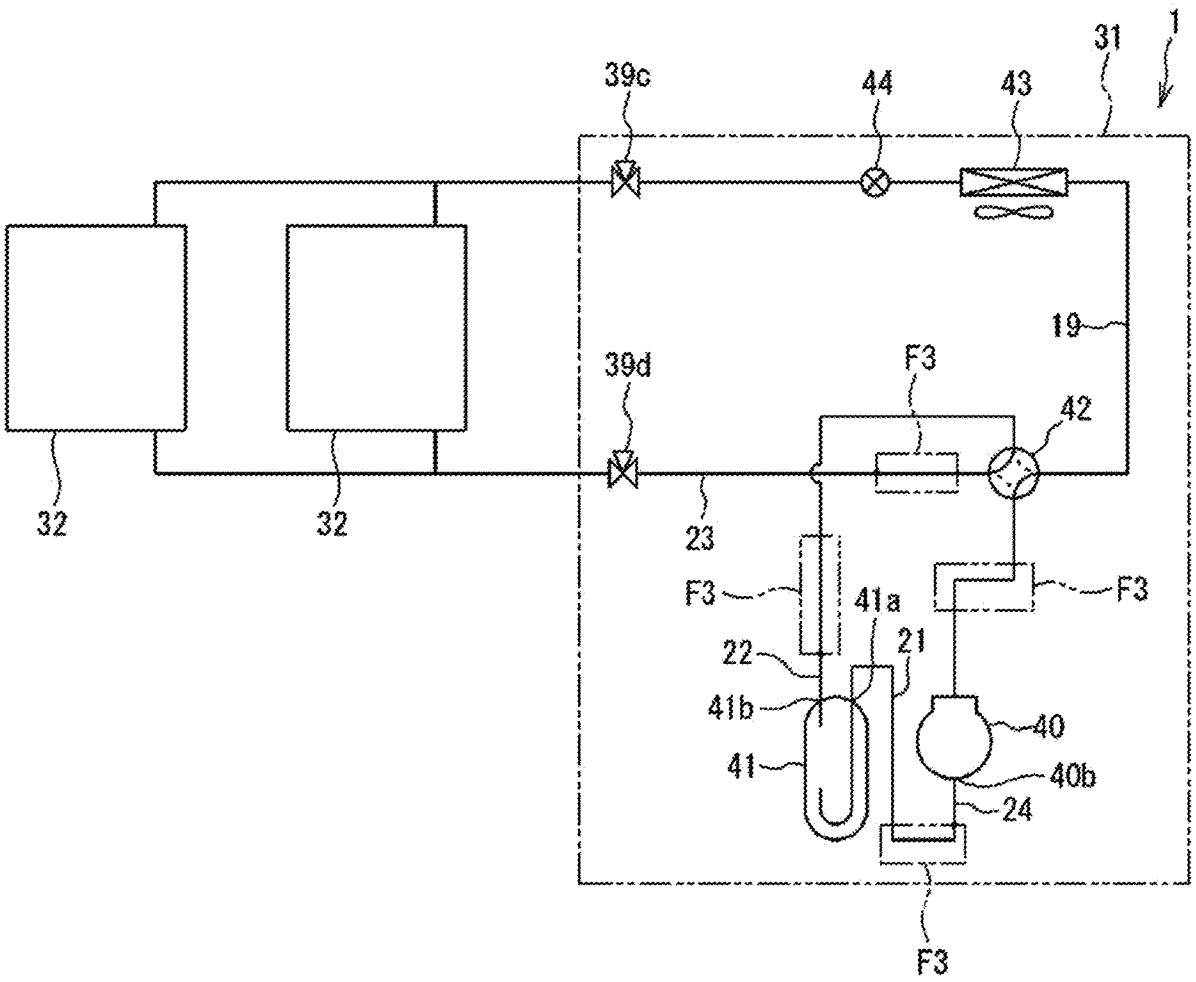
FIG. 10 is a pattern view depicting a refrigerant circuit of a refrigeration apparatus according to a second embodiment.

FIG. 10 is a pattern view depicting a refrigerant circuit of a refrigeration apparatus according to the second embodiment.

The refrigeration apparatus 1 according to the first embodiment is configured as the air conditioner of the so-called freely cooling and heating type, and includes the flow path switching device 33 disposed between the outdoor unit 31 and the indoor units 32. The present embodiment provides a refrigeration apparatus 1 including no such flow path switching device 33 and including an outdoor unit 31 and an indoor unit 32 connected directly via a connection pipe.

Figure 11:
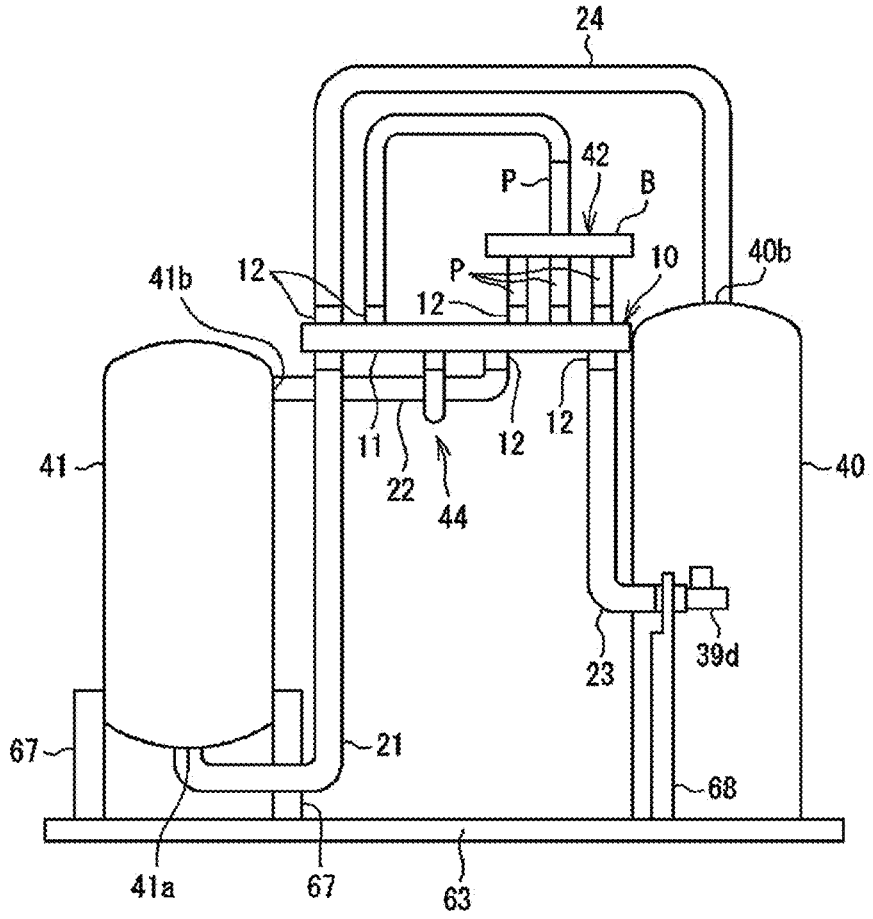
FIG. 11 is a schematic side view of a refrigerant flow path module according to the second embodiment.

FIG. 11 is a schematic side view of a refrigerant flow path module according to the second embodiment.

The outdoor unit 31 according to the present embodiment includes a single refrigerant flow path module 10. This refrigerant flow path module 10 constitutes refrigerant flow paths in frames F3 in FIG. 10. Also in the present embodiment, the refrigerant flow path module 10 is supported from below by a plurality of refrigerant pipes 21, 22, and 23.

Specifically, similarly to the first embodiment, the refrigerant flow path module 10 according to the present embodiment has a lower end connected with the refrigerant pipe 21 connected to a refrigerant outflow port 41*a* of an accumulator 41 and the refrigerant pipe 22 connected to a refrigerant inflow port 41*b*.

The lower end of the refrigerant flow path module 10 is also connected with the refrigerant pipe 23 connected to a shutoff valve 39*d* serving as an outlet or an inlet for a gas refrigerant from the indoor unit 32. The shutoff valve 39*d* is attached and fixed to a fixture 68 provided on a bottom plate 63 of a casing 60. The refrigerant pipe 23 is bent and extends upward from the shutoff valve 39*d*, and is connected to a joint tube 12 provided on a lower surface of a module body 11 of the refrigerant flow path module 10.

The refrigerant flow path module 10 according to the present embodiment is thus disposed above the bottom plate 63 of the casing 60, and is supported from below by the refrigerant pipe 21, the refrigerant pipe 22, and the refrigerant pipe 23. The refrigerant pipe 21, the refrigerant pipe 22, and the refrigerant pipe 23 are gas pipes for a gas refrigerant flow. The gas pipes are larger in pipe diameter and higher in strength than a liquid pipe for a liquid refrigerant flow. The refrigerant flow path module 10 is thus stably supported by these refrigerant pipes 21, 22, and 23. The refrigerant pipe 21 and the refrigerant pipe 22 are connected to the accumulator 41 fixed to the casing 60, whereas the refrigerant pipe 23 is connected to the shutoff valve 39*d* fixed to the casing 60. Accordingly, the refrigerant flow path module 10 is more stably supported by the refrigerant pipes 21, 22, and 23 via the components 41 and 39*d* constituting the refrigerant circuit fixed to the casing 60.

The module body 11 of the refrigerant flow path module 10 has an upper surface connected with a refrigerant pipe 24 connected to a refrigerant inflow port 40*b* of a compressor 40. The refrigerant pipe 24 extends upward from a connecting portion to the refrigerant inflow port 40*b* of the compressor 40, is further bent to extend horizontally, is bent again to extend downward, and has a lower end connected to a joint tube 12 provided on the upper surface of the module body 11.

Accordingly, the refrigerant flow path module 10 is supported also from above by the refrigerant pipe 24. The refrigerant pipe 24 is a gas pipe for a gas refrigerant flow, and is larger in diameter and higher in strength than a liquid pipe. The refrigerant flow path module 10 is thus stably supported by the refrigerant pipe 24. The compressor 40 is fixed via a fixture or the like provided on the bottom plate 63 of the casing 60. Accordingly, the refrigerant flow path module 10 is more stably supported by the refrigerant pipe 24 via the compressor 40 fixed to the bottom plate 63.

The refrigerant flow path module 10 has an upper end connected with a flow path switching valve 42. The flow path switching valve 42 includes a valve body B incorporating a valve disc, and a plurality of ports P each serving as a refrigerant outlet or inlet for the valve body B. The ports P project upward and downward from the valve body B. Among these ports, the port P projecting downward is connected directly to the joint tube 12 provided on the upper surface of the module body 11 of the refrigerant flow path module 10.

Third Embodiment

Figure 12:
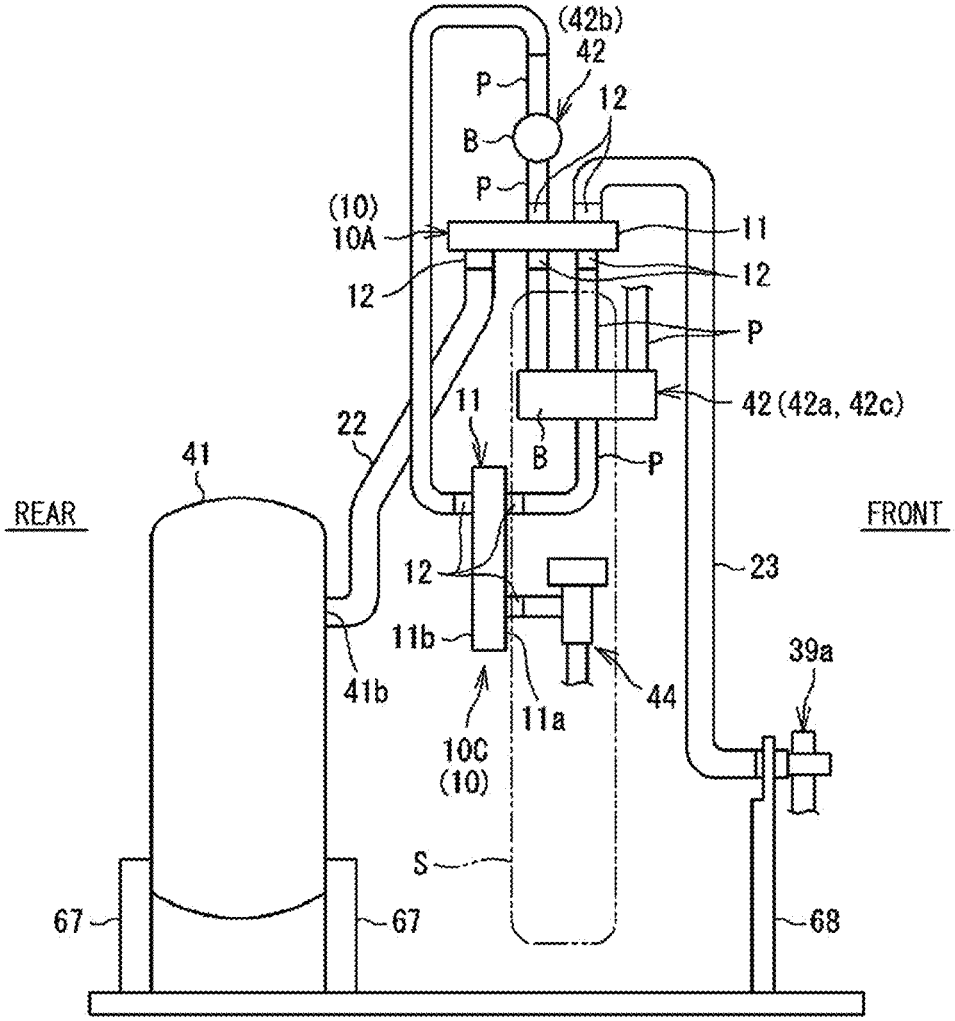
FIG. 12 is a schematic side view of a refrigerant flow path module according to a third embodiment.
Figure 13:
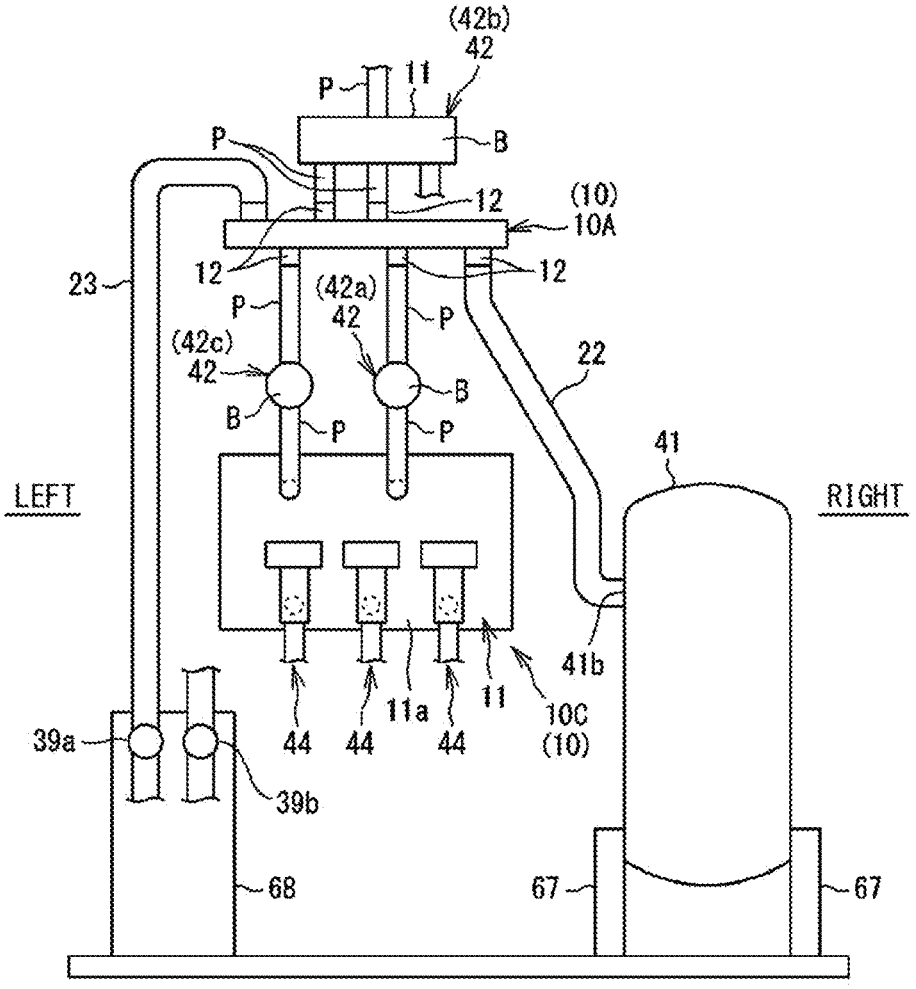
FIG. 13 is a schematic front view of the refrigerant flow path module.

FIG. 12 is a schematic side view of a refrigerant flow path module according to the third embodiment. FIG. 13 is a schematic front view of the refrigerant flow path module.

Similarly to the first embodiment, the present embodiment provides a refrigerant flow path module 10 including an upper refrigerant flow path module 10A and a lower refrigerant flow path module 10C. The lower refrigerant flow path module 10C according to the present embodiment includes a module body (second module body) 11 directed differently from the direction according to the first embodiment, specifically in the vertical direction.

The second module body 11 is constituted by a plurality of stacked plates, and has a plate or block shape. The second module body 11 according to the present embodiment includes the plurality of plates stacked in the horizontal direction (anteroposterior direction). The second module body 11 includes a front surface (first side surface) 11*a* and a rear surface (second side surface) 11*b* each having a rectangular shape in a front view (or a rear view). The front surface 11*a* and the rear surface 11*b* are facing opposite to each other.

The front surface 11*a* and the rear surface 11*b* of the second module body 11 are directed substantially in the vertical direction. The front surface 11*a* and the rear surface 11*b* of the second module body 11 may not be directed exactly in a normal direction, and may exemplarily be slanted by at most ±10° from the normal direction. The front surface 11*a* and the rear surface 11*b* of the second module body 11 are directed substantially in the transverse direction. The front surface 11*a* and the rear surface 11*b* of the second module body 11 may not be directed exactly in the transverse direction, and may exemplarily be slanted by at most ±45° from the transverse direction. The second module body 11 disposed in such a range facilitates maintenance, replacement, and the like of components such as valves 42*a*, 42*c*, and 44 attached to the front surface 11*a* as to be described later.

A length between the front surface 11*a* and the rear surface 11*b* of the second module body 11, in other words, a thickness of the second module body 11, is less than a vertical length of the second module body 11, in other words, a height of the second module body 11. The thickness of the second module body 11 is less than a transverse length of the second module body 11.

The lower refrigerant flow path module 10C is disposed below and apart from the upper refrigerant flow path module 10A. The lower refrigerant flow path module 10C is positioned to be at least partially overlapped with the upper refrigerant flow path module 10A in a planar view. The lower refrigerant flow path module 10C is shifted to one anteroposterior side (to a rear side) of the upper refrigerant flow path module 10A. The lower refrigerant flow path module 10C may be supported by a support member fixed onto a bottom plate 63 of a casing 60, and may be supported substantially by the upper refrigerant flow path module 10A via a refrigerant pipe and a component constituting a refrigerant circuit.

The upper refrigerant flow path module 10A is thus provided therebelow with a vertically wide space S. Particularly below the upper refrigerant flow path module 10A and ahead of the lower refrigerant flow path module 10C, the space S expands widely and continuously to an upper end and a lower end of the lower refrigerant flow path module 10C.

This space S is provided with the flow path switching valves 42*a* and 42*c*, the expansion valve 44, a different refrigerant pipe, and the like. The flow path switching valve 42*a* and 42*c* each have an upper port P connected directly to a joint tube 12 provided on a lower surface of the first module body 11 of the upper refrigerant flow path module 10A, and a lower port P connected to a joint tube 12 provided on the front surface 11*a* of the second module body 11 of the lower refrigerant flow path module 10C directly or via a different pipe (e.g. a pipe bent at a right angle). The expansion valve 44 is connected directly to a joint tube 12 provided on the front surface 11*a* of the second module body 11 of the lower refrigerant flow path module 10C.

The front surface (first side surface) 11*a* of the second module body 11 faces a front panel 66 and a maintenance opening 60*a* of the casing 60. The flow path switching valves 42*a* and 42*c* and the expansion valve 44 are attached to the front surface 11*a* of the second module body 11, and maintenance and replacement of components can thus be easily executed via the maintenance opening 60*a* opened by detaching the front panel 66.

The lower refrigerant flow path module 10C may alternatively be shifted to a front side of the upper refrigerant flow path module 10A. In this case, the space S widened vertically is provided behind the lower refrigerant flow path module 10C and below the upper refrigerant flow path module 10A. The lower refrigerant flow path module 10C may alternatively be not overlapped with the upper refrigerant flow path module 10A in a planar view. In the case where the lower refrigerant flow path module 10C is shifted to the front side of the upper refrigerant flow path module 10A, the lower refrigerant flow path module 10C may be supported by a support member extending from a fixture 68.

A refrigerant pipe 23 connected to a first shutoff valve (gas shutoff valve) 39*a* is connected to an upper end of the upper refrigerant flow path module 10A. Specifically, the refrigerant pipe 23 is bent and extends upward from the first shutoff valve 39*a*, and has an upper end connected to a joint tube 12 provided on an upper surface of the first module body 11 of the upper refrigerant flow path module 10A.

A refrigerant pipe 22 connected to a refrigerant inflow port 41*b* of an accumulator 41 is connected to a lower end of the upper refrigerant flow path module 10A. Specifically, the refrigerant pipe 22 is connected to a joint tube 12 provided on the lower surface of the first module body 11 of the upper refrigerant flow path module 10A.

Accordingly, the upper refrigerant flow path module 10A according to the present embodiment is supported from below by the refrigerant pipe 22 and is supported from above by the refrigerant pipe 23. The refrigerant pipe 22 and the refrigerant pipe 23 are gas pipes for a gas refrigerant flow, and are larger in pipe diameter and higher in strength than a liquid pipe for a liquid refrigerant flow. The upper refrigerant flow path module 10A is thus stably supported by these refrigerant pipes 22 and 23. The refrigerant pipe 22 is connected to the accumulator 41 fixed to the casing 60 and the refrigerant pipe 23 is connected to the first shutoff valve 39*a* fixed to the casing 60. Accordingly, the upper refrigerant flow path module 10A is more stably supported by the refrigerant pipes 22 and 23 via the components 41 and 39*a* constituting the refrigerant circuit fixed to the casing 60. The upper refrigerant flow path module 10A may alternatively be supported by a different refrigerant pipe (e.g. the refrigerant pipe 21, 24, or 25 according to the first embodiment).

Figure 14:
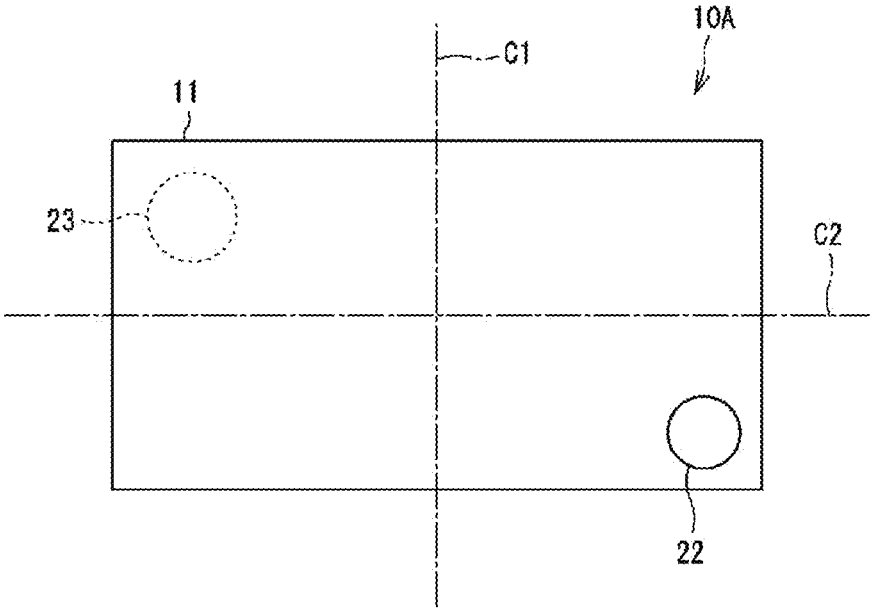
FIG. 14 is a bottom view of a schematic module body, indicating disposition of refrigerant pipes supporting the refrigerant flow path module.

FIG. 14 is a bottom view of a schematic module body, indicating disposition of refrigerant pipes supporting the refrigerant flow path module.

The two refrigerant pipes 22 and 23 supporting the upper refrigerant flow path module 10A are connected at positions distributed on both sides of a center C1 in the longitudinal direction of the module body 11. Specifically, the refrigerant pipe 22 is disposed on a first side of the center C1 in the longitudinal direction, whereas the refrigerant pipe 23 is disposed on a second side of the center C1 in the longitudinal direction. The plurality of refrigerant pipes 22 and 23 is accordingly distributed on both sides of the center C1 in the longitudinal direction of the module body 11. The plurality of refrigerant pipes 22 and 23 is dispersed in the longitudinal direction of the module body 11. The plurality of refrigerant pipes 22 and 23 can thus stably support the upper refrigerant flow path module 10A in a well-balanced manner.

The two refrigerant pipes 22 and 23 are connected at positions distributed on both sides of a center C2 in the short direction of the module body 11. Specifically, the refrigerant pipe 22 is disposed on a first side of the center C2 in the short direction, whereas the refrigerant pipe 23 is disposed on a second side of the center C2 in the short direction. The plurality of refrigerant pipes 22 and 23 is accordingly distributed and dispersed on both sides in the longitudinal direction as well as in the short direction of the module body 11. The two refrigerant pipes 22 and 23 can thus stably support the upper refrigerant flow path module 10A in a well-balanced manner.

Other Embodiments

The upper refrigerant flow path module 10A according to the first embodiment is supported from below by the three refrigerant pipes 21 to 23, and may alternatively be supported from below by two refrigerant pipes. In this case, the two refrigerant pipes are preferably distributed on both sides in the longitudinal direction of the module body 11 of the upper refrigerant flow path module 10A. The upper refrigerant flow path module 10A may still alternatively be supported from below by four or more refrigerant pipes. The lower refrigerant flow path module 10B instead of the upper refrigerant flow path module 10A may be supported from below by two or more refrigerant pipes.

The heat exchanger 43 according to the above embodiments includes the four heat exchange units 43*a* to 43*d*. The heat exchanger 43 may alternatively include two heat exchange units. In this case, any one of the flow path switching valves 42*a* and 42*c* can be excluded and any one of the expansion valves 44*a* and 44*b* can be excluded. When the number of the flow path switching valves decreases, the flow path switching valve 42*b* provided at the top of the upper refrigerant flow path module 10A may exemplarily be disposed between the upper refrigerant flow path module 10A and the lower refrigerant flow path module 10B or 10C.

Action and Effects of Embodiments

Technical Problem

The refrigerant pipe unit according to PATENT LITERATURE 1 has an upper surface provided with the compressor, and is thus disposed limitedly at a lower position in the heat source unit, such as on a bottom part of a casing of the heat source unit. Meanwhile, the refrigerant circuit in the heat source unit is provided with relatively large components such as an accumulator and an oil separator in addition to the compressor, and an inflow port or an outflow port for a refrigerant is typically provided at the top of each of these components. Accordingly, the refrigerant pipe unit disposed at a lower position in the heat source unit leads to increase in length of a refrigerant pipe connecting the inflow port or the outflow port of each component like the compressor and the refrigerant pipe unit, and leads to increase in amount of used refrigerant pipes. It is an object of the present disclosure to provide a heat source unit achieving reduction in amount of used refrigerant pipes.

Action and Effects

The heat source unit (outdoor unit) 31 according to the above embodiments includes the compressor 40, the refrigerant pipes 21 to 25 for a flow of a gas refrigerant having been discharged from the compressor 40 and a flow of a gas refrigerant to be sucked into the compressor 40, the refrigerant flow path module 10 connected to the refrigerant pipes 21 to 25, and the casing 60 accommodating the compressor 40, the refrigerant pipes 21 to 25, and the refrigerant flow path module 10. The refrigerant flow path module 10 includes the module body 11 having the upper surface and the lower surface, having the vertical length less than the horizontal length, and provided therein with the refrigerant flow path. The refrigerant flow path module 10 is disposed above and apart from the bottom part (bottom plate) 63 of the casing 60. The refrigerant pipes 21 to 25 include a first pipe and a second pipe (any two of the refrigerant pipes 21 to 23 according to the above embodiments) communicating with the flow path in the module body 11 and supporting the refrigerant flow path module 10. The refrigerant flow path module 10 thus configured is disposed above the bottom plate (bottom part) 63 of the casing 60 and is enhanced in disposition flexibility in the casing 60. Accordingly, the refrigerant pipe connecting a component such as the compressor 40 and the refrigerant flow path module 10 can be shortened in comparison to the case where the refrigerant flow path module 10 is disposed in the bottom part of the casing 60. The refrigerant flow path module 10 is supported by the first and second pipes 21 22, or 23 for a gas refrigerant flow, so as to simplify a structure for disposition of the refrigerant flow path module 10 above the bottom part 63 of the casing 60.

The first and second pipes 21, 22, or 23 according to the first or second embodiment support the refrigerant flow path module 10 from below. The refrigerant flow path module 10 can thus be stably supported from below.

According to the above embodiments, the module body 11 is elongated in a horizontal predetermined direction. As depicted in FIG. 6, FIG. 8, FIG. 9, and FIG. 14, the connecting portions of the first pipe and the second pipe (e.g. any of the refrigerant pipes 21 to 23) to the refrigerant flow path module 10 are distributed on both sides of the center C1 in the longitudinal direction of the module body 11. This achieves well-balanced support of the refrigerant flow path module 10 by the first and second pipes 21 and 23.

According to the above embodiments, the heat source unit 31 further includes the switching mechanism (flow path switching valve) 42 configured to switch a flow direction of a gas refrigerant, and the gas shutoff valve 39*a* or 39*d* constituting the outlet or the inlet of the gas refrigerant in the heat source unit 31. The first pipe and the second pipe (any two of the refrigerant pipes 21 to 23 according to the above embodiments) each constitute part of the first flow path for a refrigerant flow between the discharge side of the compressor 40 and the switching mechanism 42, part of the second flow path for a refrigerant flow between the suction side of the compressor 40 and the switching mechanism 42, or part of the third flow path for a refrigerant flow between the gas shutoff valve 39*a* and the switching mechanism 42. For example, the first pipe or the second pipe corresponds to the refrigerant pipe 23 constituting part of the third flow path and connecting the gas shutoff valve 39*a* or 39*d* fixed to the casing 60 and the refrigerant flow path module 10. Such a configuration achieves stable support of the refrigerant flow path module 10 by the gas shutoff valve 39*a* fixed to the casing 60 and the refrigerant pipe 23.

The above embodiments further provide the accumulator 41 provided on the second flow path for a refrigerant flow between the suction side of the compressor 40 and the switching mechanism 42 and fixed to the casing 60. The first pipe or the second pipe (the refrigerant pipe 21 or 22 according to the above embodiments) corresponds to the refrigerant pipe connecting the accumulator 41 and the refrigerant flow path module 10. Such a configuration achieves stable support of the refrigerant flow path module 10 by the accumulator 41 fixed to the casing 60 and the first or second pipe.

According to the above embodiments, the switching mechanism 42 includes the ports P each for a refrigerant inflow or outflow, and the ports P are connected directly to the refrigerant flow path module 10. This enables reduction in amount of refrigerant pipes in the heat source unit 31.

According to the above embodiments, as depicted in FIG. 7, FIG. 12, and FIG. 13, the refrigerant flow path module 10 includes the joint tubes 12 each having the upper end connected to the lower surface of the module body 11 and the lower end connected to the first pipe (any one of the refrigerant pipes 21 to 23) or the second pipe (any one of the refrigerant pipes 21 to 23). The first or second pipe 21, 22, or 23 has the upper end provided with the diameter expanded part D having an expanded inner diameter, and first and second joint tubes 12 are each inserted into the diameter expanded part D of the first or second pipe 21, 22, or 23. This facilitates manual brazing of the first or second pipe 21, 22, or 23 to one of the joint tubes 12 of the refrigerant flow path module 10.

According to the first or second embodiment, the refrigerant pipes 21 to 25 further include the third pipe (any one of the refrigerant pipes 21 to 23 according to the above embodiments) communicating with the flow path in the module body 11 and supporting the refrigerant flow path module 10 from below, and the connecting portions of the first to third pipes 21 to 23 to the refrigerant flow path module 10 are dispersed in the longitudinal direction of the module body 11. This configuration achieves more stable support of the refrigerant flow path module 10 by the three refrigerant pipes, namely, the first to third pipes 21 to 23, and achieves well-balanced support of the refrigerant flow path module 10 by the first to third pipes 21 to 23 in the longitudinal direction of the module body 11.

The refrigerant pipes 21 to 25 according to the first or second embodiment further includes a fourth pipe 24 communicating with the flow path in the module body 11 and supporting the refrigerant flow path module 10 from above. Such a configuration achieves more stable support of the refrigerant flow path module 10 by the fourth pipe 24.

The refrigerant flow path module 10 according to the above embodiments includes the first refrigerant flow path module (e.g. the upper refrigerant flow path module 10A) including the module body 11 and supported by the first pipe and second pipe, and the second refrigerant flow path module (e.g. the lower refrigerant flow path module 10B or 10C) disposed vertically apart from the first refrigerant flow path module and including the second module body 11 provided therein with the refrigerant flow path.

In an exemplary case where a single refrigerant flow path module is concentratedly connected with a plurality of refrigerant pipes and is provided with a plurality of refrigerant flow paths, the refrigerant flow path module needs to be large in order to avoid interference or the like between the refrigerant pipes or the refrigerant flow paths. This increases a portion provided with no flow path and a portion connected with no refrigerant pipe. This leads to difficulty in efficient connection of the plurality of refrigerant pipes and provision of the flow paths to the refrigerant flow path module. The refrigerant flow path module increased in size leads to increase in installation space (particularly an installation space in the horizontal direction) in the casing 60. The refrigerant flow path module 10 according to the present embodiment is constituted by the two modules, namely, the first refrigerant flow path module 10A and the second refrigerant flow path module 10B or 10C, so as to achieve efficient provision of the flow paths in the respective refrigerant flow path modules 10A and 10B or 10C as well as entire size reduction of the refrigerant flow path module 10. The installation space in the horizontal direction can be decreased when the two refrigerant flow path modules 10A and 10B or 10C are disposed vertically apart from each other and are overlapped with each other in a top view.

The refrigerant pipes according to the first embodiment include a fifth pipe 25 extending vertically between the first refrigerant flow path module 10A and the second refrigerant flow path module 10B, and having an upper end connected to one of the first refrigerant flow path module 10A and the second refrigerant flow path module 10B and a lower end connected to the remaining one of the first refrigerant flow path module 10A and the second refrigerant flow path module 10B. This configuration enables connection between the first refrigerant flow path module 10A and the second refrigerant flow path module 10B by the fifth pipe 25 in a shortest distance.

The first embodiment provides the switching mechanisms 42*a* and 42*c* each configured to switch a flow direction of a gas refrigerant, and the switching mechanisms 42*a* and 42*c* are disposed between the first refrigerant flow path module 10A and the second refrigerant flow path module 10B. Such a configuration enables effective use of the space between the first refrigerant flow path module 10A and the second refrigerant flow path module 10B.

According to the third embodiment, the second module body 11 includes the first side surface (e.g. the front surface) 11*a* and the second side surface (e.g. the rear surface) 11*b* directed in the vertical direction and facing opposite to each other, and the length between the first side surface 11*a* and the second side surface 11*b* is less than the vertical length of the second module body 11. According to such a configuration, the vertically wide space S can be secured above or below (adjacent to the second refrigerant flow path module 10C) the first refrigerant flow path module 10A even when the second refrigerant flow path module 10C is disposed vertically apart from the first refrigerant flow path module 10A, so as to enhance disposition flexibility of components such as refrigerant pipes and valves connected respectively to the refrigerant flow path modules 10A and 10C.

The embodiments have been described above. Various modifications to modes and details will be available without departing from the object and the scope of the claims.

For example, the number of the plates constituting the module body of the refrigerant flow path module should not be particularly limited, and has only to be two or more.

Components connected to the upper end and the lower end of the refrigerant flow path module 10 can be appropriately changed in terms of their types. For example, a refrigerant pipe supporting the refrigerant flow path module from below can be a refrigerant pipe provided for a gas refrigerant flow and extending from the oil separator 46, or a refrigerant pipe provided for a gas refrigerant flow and extending from the heat exchanger 43.

REFERENCE SIGNS LIST

10 refrigerant flow path module
10A upper refrigerant flow path module (first refrigerant flow path module)
10B lower refrigerant flow path module (second refrigerant flow path module)
10C lower refrigerant flow path module (second refrigerant flow path module)
11 module body
12 joint tube
21 refrigerant pipe (first, second, or third pipe)
22 refrigerant pipe (first, second, or third pipe)
23 refrigerant pipe (first, second, or third pipe)
24 refrigerant pipe (fourth pipe)
25 refrigerant pipe (fifth pipe)
31 outdoor unit (heat source unit)
39*a* shutoff valve
39*d* shutoff valve
40 compressor
41 accumulator
42 flow path switching valve (switching mechanism)
42*a* flow path switching valve (switching mechanism)
42*b* flow path switching valve (switching mechanism)
42*c* flow path switching valve (switching mechanism)
60 casing
63 bottom plate (bottom part)
C1 center
C2 center
D diameter expanded part
P port

What is claimed is:

1. A heat source unit comprising:
a compressor;
refrigerant pipes for a first flow of a gas refrigerant having been discharged from the compressor and a second flow of the gas refrigerant to be sucked into the compressor;
at least one refrigerant flow path module connected to the refrigerant pipes; and
a casing accommodating the compressor, the refrigerant pipes, and the refrigerant flow path module,
wherein
the at least one refrigerant flow path module includes a module body having an upper surface and a lower surface, having a vertical length less than a horizontal length, and provided therein with a flow path for a refrigerant,
the at least one refrigerant flow path module is disposed above and apart from a bottom part of the casing,
the refrigerant pipes include a first pipe and a second pipe each communicating with the flow path in the module body and supporting the refrigerant flow path module,
the first pipe and the second pipe support the refrigerant flow path module from below, and
the module body is constituted by a plurality of stacked plates, and has a plate or block shape.

2. The heat source unit according to claim 1, wherein
the module body is elongated in a horizontal predetermined direction, and
the first pipe and the second pipe have connecting portions to the at least one refrigerant flow path module, and the connecting portions are distributed on both sides of a center in a longitudinal direction of the module body.

3. The heat source unit according to claim 1, further comprising:

a flow path switching valve including ports each for a refrigerant inflow or outflow and being configured to switch a flow direction of the gas refrigerant; and a gas shutoff valve constituting an outlet or an inlet of the gas refrigerant in the heat source unit, wherein the first pipe or the second pipe each constitute part of a first flow path for a refrigerant flow between a discharge side of the compressor and the flow path switching valve, part of a second flow path for a refrigerant flow between a suction side of the compressor and the flow path switching valve, or part of a third flow path for a refrigerant flow between the gas shutoff valve and the flow path switching valve.

4. The heat source unit according to claim 3, wherein the gas shutoff valve is fixed to the casing, and the first pipe or the second pipe forms part of the third flow path and connects the gas shutoff valve and the at least one refrigerant flow path module.

5. The heat source unit according to claim 3, further comprising an accumulator provided on the second flow path and fixed to the casing, wherein the first pipe or the second pipe connects the accumulator and the at least one refrigerant flow path module.

6. The heat source unit according to claim 3, wherein the flow path switching valve includes a port for a refrigerant outflow or inflow, and the port is connected directly to the at least one refrigerant flow path module.

7. The heat source unit according to claim 1, wherein the at least one refrigerant flow path module includes a joint tube having an upper end connected to the lower surface of the module body and a lower end connected to the first pipe or the second pipe, the first pipe or the second pipe has an upper end provided with a diameter expanded part having an expanded inner diameter, and the joint tube is inserted into the diameter expanded part of the first pipe or the second pipe.

8. The heat source unit according to claim 1, wherein the refrigerant pipes further include a third pipe communicating with the flow path in the module body and supporting the at least one refrigerant flow path module from below, and the first to third pipes have connecting portions to the at least one refrigerant flow path module, and the connecting portions are dispersed in a longitudinal direction of the module body.

9. The heat source unit according to claim 1, wherein the refrigerant pipes further include a fourth pipe communicating with the flow path in the module body and supporting the at least one refrigerant flow path module from above.

10. A heat source unit, comprising:

a compressor;

refrigerant pipes for a first flow of a gas refrigerant having been discharged from the compressor and a second flow of the gas refrigerant to be sucked into the compressor;

at least one refrigerant flow path module connected to the refrigerant pipes; and a casing accommodating the compressor, the refrigerant pipes, and the refrigerant flow path module, wherein the at least one refrigerant flow path module includes a module body having an upper surface and a lower surface, having a vertical length less than a horizontal length, and provided therein with a first flow path for a refrigerant, the at least one refrigerant flow path module is disposed above and apart from a bottom part of the casing, the refrigerant pipes include a first pipe and a second pipe each communicating with the flow path in the module body and supporting the refrigerant flow path module, the at least one refrigerant flow path module includes a first refrigerant flow path module having the module body and supported by the first pipe and second pipe, and a second refrigerant flow path module disposed vertically apart from the first refrigerant flow path module and having a second module body provided therein with a second flow path for the refrigerant, and the module body is constituted by a plurality of stacked plates, and has a plate or block shape.

11. The heat source unit according to claim 10, wherein the refrigerant pipes include a fifth pipe extending vertically between the first refrigerant flow path module and the second refrigerant flow path module, and having an upper end connected to one of the first and second refrigerant flow path modules and a lower end connected to a remaining one of the first and second refrigerant flow path modules.

12. The heat source unit according to claim 10, further comprising a flow path switching valve including ports each for a refrigerant inflow or outflow and being configured to switch a flow direction of the gas refrigerant, wherein the flow path switching valve is disposed between the first refrigerant flow path module and the second refrigerant flow path module.

13. The heat source unit according to claim 10, wherein the second module body has a first side surface and a second side surface directed vertically and facing opposite to each other, and a length between the first side surface and the second side surface is less than a vertical length of the second module body.

* * * * *